US005807067A

United States Patent [19]

Burdick

[11] Patent Number: 5,807,067

[45] Date of Patent: Sep. 15, 1998

[54] TRANSTATOR HYDRAULICS DEVICE

[76] Inventor: George D. Burdick, 301 NE. 2d St., Plainville, Kans. 67663

[21] Appl. No.: 606,557

[22] Filed: Feb. 26, 1996

[51] Int. Cl.[6] ..... F04D 23/00

[52] U.S. Cl. ..... 415/6; 415/8; 417/423.1

[58] Field of Search ..... 415/148, 182.1, 415/206, 6, 8; 417/423.1, 423.14

[56] References Cited

U.S. PATENT DOCUMENTS

| | | | |
|---|---|---|---|
| 3,791,757 | 2/1974 | Tarifa et al. | 417/423.1 |
| 4,163,636 | 8/1979 | Botsch et al. | 415/6 |
| 4,417,851 | 11/1983 | Cygnor et al. | 415/150 |
| 4,643,639 | 2/1987 | Caine | 415/148 |
| 4,779,575 | 10/1988 | Perkins | 415/206 |
| 5,409,351 | 4/1995 | Geist | 415/159 |

FOREIGN PATENT DOCUMENTS

| | | | |
|---|---|---|---|
| 45793 | 3/1985 | Japan | 415/6 |

*Primary Examiner*—John T. Kwon
*Attorney, Agent, or Firm*—Bradley P. Sylvester

[57] ABSTRACT

A rotary impeller pump that moves fluid using a rotary impeller, where at least one transtator, having one or more ports, is positioned within a groove on a front plate that is adjacent to the impeller, and where the transtator is movable within its groove. The port is positioned radially in relation to the impeller's axis of rotation, by moving the transtator, thus allowing fluid having specific pressures and flow rates at various points of radius of the impeller, to be directed to an exit port.

21 Claims, 8 Drawing Sheets

TRANSTATOR HYDRAULICS DEVICE

BACKGROUND OF THE INVENTION

Centrifugal pumps of conventional design are used to move liquid of varying densities and viscosities. The output of these pumps is generally at a set volume or pressure, depending on the speed of the rotating impeller, the size of the vanes, and the fluid consistency. Adjusting the output of the pump flow rate has been accomplished through restricting the outlet opening or openings, varying the speed of the impeller rotation, or altering the impeller vane structure or spacing. There are times when a single pumping source is desired for multiple pressure lines. In order to make this type of apparatus usable, the ability to modify each line's pressure must be available. To date, the use of multiple pressure lines, each adjustable as to pressure independent of the other lines, all emanating from a single centrifugal pump source has not been disclosed. Some variations on portions of this theme have been previously disclosed.

U.S. Pat. No. 4,417,851 (Cygnor) discloses a centrifugal pump that had a plurality of valve elements, but these valve elements were stationary. Any type of pressure modification required a varying of the impeller speed, or varying of the number of valves actuated. One of the valve's primary purposes was to assist in the removal of solid particulate matter within the liquid.

U.S. Pat. No. 4,643,639 (Caine) discloses a centrifugal pump that used a slide mechanism to restrict the discharge opening and flow of fluid. The discharge opening remained stationary, and the housing had a series of passageways that could be opened or closed, to increase or decrease the amount of fluid being pumped. While this particular patent was able to handle temperature increases in the pumping liquid, it was not able to deliver multiple independently variable pressure and volume outputs.

U.S. Pat. No. 5,409,351 (Geist) describes an invention where inlet openings are adjusted as to being opened, closed or partially closed, so that the flow through the turbine is controlled. This type of pump or turbine, as well as the ones described above, fails to accomplish multiple pressure and volume output lines, with each line being able to have a different set pressure, all emanating from the same pump unit.

There are untold uses for a single pump source, with multiple independently adjustable output pressure and volume output lines. The field of robotics and any type of sophisticated hydraulic or pressure sensitive systems would benefit greatly from such an apparatus.

SUMMARY OF THE INVENTION

This invention relates to an adjustable multi-pressure liquid delivery system, in which a single centrifugal pump supplies one or more pressure output lines with pressure, and where the pressure and flow rate in each of the lines is independently varied according to the particular need. This system can be used with various types of liquids, with the advantage being that a single pressure supply pump is capable of properly operating numerous hydraulic system lines, each with their own particular pressure requirements.

A typical centrifugal pump, with an open vane rotary impeller, is used as the pressure supply source. The pump itself has a drive unit, typically an electric motor, which spins the rotary impeller at a given or adjustable rate. The impeller has several vanes, which protrude outward from the impeller plate, and run radially outward from the central portion of the impeller.

When liquid is placed into the area between the vanes, the rotation of the impeller will cause the liquid to be forced outward. If sufficient liquid is present, the pressure exerted by the liquid will increase, the further out it is from the center of the impeller.

Several variables will affect the amount of pressure exerted by the liquid due to the impeller's rotation. The first variable is the density of the working fluid. A given impeller at a given rpm will have greater effect on fluids with higher densities than fluids of lower densities. For example, a very small impeller, using mercury as the working fluid, will be able to provide a level of pressure force, equal to that provided by a much larger impeller that is using water as the working fluid. This is due to the amount of centrifugal force transferred to the liquid by the impeller. Mercury, a heavy liquid, has a much greater force when it is moved, than an equal volume of water, a much lighter liquid. The second variable is the rate of the impeller's rotation. The faster the impeller spins, the greater the pressure exerted by the fluid as it reaches the periphery of the impeller. The third variable is the diameter of the impeller, since an impeller of greater size will transfer considerable force to liquid on its periphery, even at slower rotation rates, than a similar but smaller diameter impeller. A fourth variable involves the flow rate of the fluid through a centrifugal pump at a given point in time. An increase in flow rate effectively reduces the amount of delivered pressure, in a centrifugal pump apparatus, at a constant rate of impeller rotation.

At the center of the impeller, the fluid is at zero or a very low pressure. As one moves toward the periphery of the impeller vanes, during impeller rotation, the pressure delivered to the fluid increases. If a port is available along the length of the impeller vanes, the liquid will enter that port, exerting a pressure force equal to that exhibited by the liquid at that location on the impeller. A port which is located closer to the center of the rotating impeller will have fluid of much lower pressure entering than a port that is located near the periphery of the impeller.

This invention uses a movable port, that can be positioned at any desired point, along the length of the impeller vanes, so that any pressure, from zero or low pressure, to the maximum pressure created by the impeller, can be fed to an outlet line. This moveable port is part of a device referred to as a transtator, that moves radially, in relation to the impeller's center or axis of rotation, thereby changing the effective diameter of the impeller for that port.

"Transtator" is a word of art, and has been applied to the movable port in this invention. The first part of the word is derived from "trans", which is a prefix that means "to change thoroughly" (according to dictionary definition, i.e. Random House Dictionary), and has precedence in use, with words such as transistor, using the prefix trans combined with the word resistor.

The second part of the word "transtator" is derived from "stator", which is a common hydraulic term. It is generally applied to a port or blade that does not move rotationally, but is static with regard to rotational motion, as is the movement of this part described in this present invention. A sample definition can be stated as "a portion of a machine that remains fixed with respect to rotating parts, especially a collection of rotating parts." (See Collier Dictionary)

The linear moving portion of this apparatus is designated as a "transtator," since it is able to vary the amount of received fluid pressure from a radial pressure gradient. Fluids of increasing energy are present farther out along the impeller, with the transtator able to receive the higher fluid energy level as it moves outward along a linear path that bisects the plane of fluid rotation within the impeller.

The purpose of the movement of the transtator is the ability to access the variable pressures and flow rates that are available, not to make available an optimum port position. While this is one potential benefit that this invention can do, it is not the sole objective. It is not only to generate a variable pressure and flow rate source, but to be able to provide a source of multiple independent and variable pressure and flow rate sources.

For purposes of this summary and following description, flow direction will be described as moving from the center of the impeller toward the periphery of the impeller and pump housing, through a transtator and out a variable pressure outlet. There is nothing to say that an outside force, applied to the fluid, at any time, would apply more pressure than that acquired by the transtator port. If a cylinder meets a force, greater than that generated through the transtator, the fluid will flow toward the lower pressure. In most applications, this would be from the cylinder back into the pump apparatus. This does not necessarily mean that the fluid will flow backward out of the pump apparatus. There are no actual valves, indicated or required in this invention, which does not preclude the addition of such in the pressure delivery lines, etc.

The transtator fits within a groove in the front plate of the centrifugal pump, with negligible tolerance between the transtator and groove. The groove preferably has beveled edges, or some type of restrictive guide, that prevents the transtator from moving sideways out of the groove length. The transtator intake port is also the pump exhaust port.

The tube type transtator defines a hollow space, that runs between the transtator intake port on the bottom area of the transtator, and a transtator exit port located on the top portion of the transtator. A filler is fixed to the bottom of the transtator, with the filler being composed of a somewhat flexible material, having the same external shape as the transtator, with the filler not having any holes or ports, so that it effectively "plugs" the lower end of the transtator and the unoccupied portion of the groove. The filler is made out of a material that does not readily deform under the pressures exerted by the liquid in the impeller pump system.

It is important that the transtator and filler occupy all of the space defined by the groove. This prevents fluid at high pressures along the impeller radius, from undesirably cycling back to the area of zero or low pressure near the central part of the impeller, or its axis of rotation. The tolerance between the impeller vanes and the front plate and transtator/filler, should be negligible, preventing unwanted recycling of fluid. If the filler were left out, for example, fluid of higher pressure, just below the bottom of the transtator, would recycle back to the central part of the impeller, following the space defined by the unoccupied groove. The filler prevents this from happening.

The filler is preferably flexible, so that it can move through a filler hole, located at the portion of the groove closest to the central part of the front plate.

The front plate may have a center plug, which has one or more apertures that direct the excess filler from the groove into a filler receiver area that is located, adjacent to the central portion of the front plate and center plug. As the transtator moves along the length of the groove, away from the central portion of the front plate, it will likewise move the filler with it. Preferably, the filler has a sufficient length so that even if the transtator is moved away from the central part of the front plate as far as allowable under the settings, a portion of the filler will remain in the filler receiver area. In this manner, when the transtator is moved towards the center of the front plate, the excess filler length from the groove will be directed back into the filler receiver. At no time, during the operation of the impeller and movement of fluid, should any part of the groove length be unoccupied by either the transtator or the filler.

The transtator is positioned in the groove length using an external positioning means that is independent of the impeller pump pressure, and both moves and maintains the position of the transtator in the groove. Many options are available for this external positioning means, such as a manual positioning and locking system, an electric motor, or a double action hydraulic or pneumatic cylinder.

Whatever means is used, the transtator must be capable of being positioned at any desired point within the groove, so that the top portion of the transtator protrudes outward from the periphery of the groove, with the transtator exit port positioned outside of the confines of the groove, outward from the periphery of the front plate.

If a hydraulic cylinder is used to position the tube type transtator, the cylinder rod is fixed to the top portion of the transtator, by an appropriate means, with the actuating hydraulic cylinder moving the transtator and filler along the length of the groove, until the transtator intake port is positioned adjacent to a desired radial point of the impeller, and the resulting liquid pressure is acquired. The liquid under pressure will enter into the tube type transtator through the intake port, move through the transtator until it leaves through the transtator exit port. A flexible pressure line may be fixed directly to the transtator at the exit port location, so that the fluid is sent directly to the desired location. Alternately, the transtator top portion moves into a transtator receiver, as it is pulled outward from the groove in the front plate. Fluid moving through the transtator will move through the transtator exit port into the transtator receiver cavity, which has a variable pressure outlet, to which a pressure line can be connected. The transtator receiver cavity provides a smoother transition of the transfer of pressure from the transtator to the pressure line, than if the pressure line was connected directly to the transtator itself. This would especially be true if the transtator receiver also functioned as a diaphragm tank, which would allow for slight changes in volume depending on the pressure it received. Any fluttering, in the pressure, due to the passing of the impeller vanes over the transtator entry port, would be minimized in the transtator receiver. Also, the transtator receiver obviates the need for moving or flexible pressure lines, that change position each time there is a corresponding change in translator position.

The drive means for the impeller may be adjustable as to revolutions per minute (rpm), to provide various ranges of pressures along the impeller vanes, or it may be a set rotational rate. In either case, the adjustable nature of the translator will allow the pump unit to deliver specific pressures and flow rates, up to the maximum pressure and potential flow rate exerted along the periphery of the impeller vanes. In either case, the liquid under the greatest pressure, due to the molecular and impeller vane friction, will have an increased temperature along the periphery of the impeller. This heated liquid can be bled off through a high pressure outlet, and moved through a cooling means, to be recycled back into the zero or low pressure intake port for the pump system. If the high pressure bleed line draws a low amount of fluid from the pump system, there will be no appreciable loss of available pressure along the various points of the impeller, but the fluid in the system will be kept to a low enough temperature for optimal operating conditions.

More than one set of grooves and corresponding translators and fillers may be used with a single front plate. Technically, the only limitation on the number of grooves is the area of the front plate side. As long as the transtator and filler can fully occupy the groove space, the shape and location of the groove have little importance. The grooves should project straight out radially from the center of the front plate, but the groove path may also be angled, or curved. An alternate method is to have a rod type transtator, having a single port that is a passage through the cross section of a rod transtator, and allows fluid to flow from the cavity within the pump, through the port into a fluid channel, which has an exit port. There are numerous variations of materials, designs, and shapes that may be utilized for the components that may be used to accomplish this type of functioning apparatus.

It is an object of this invention to provide an apparatus that has one or more adjustable ports or transtators, that can be positioned radially in relationship to a rotary liquid pump impeller, so that specific pressures and potential volume rates can be directed to a particular destination line.

It is a further object of this invention to provide an apparatus that can modify existing centrifugal pumps so that the pump can deliver one or more variable liquid pressures and potential volume rates.

DESCRIPTION OF THE PREFERRED EMBODIMENT

Rotary Impeller Pump

Figure 1:
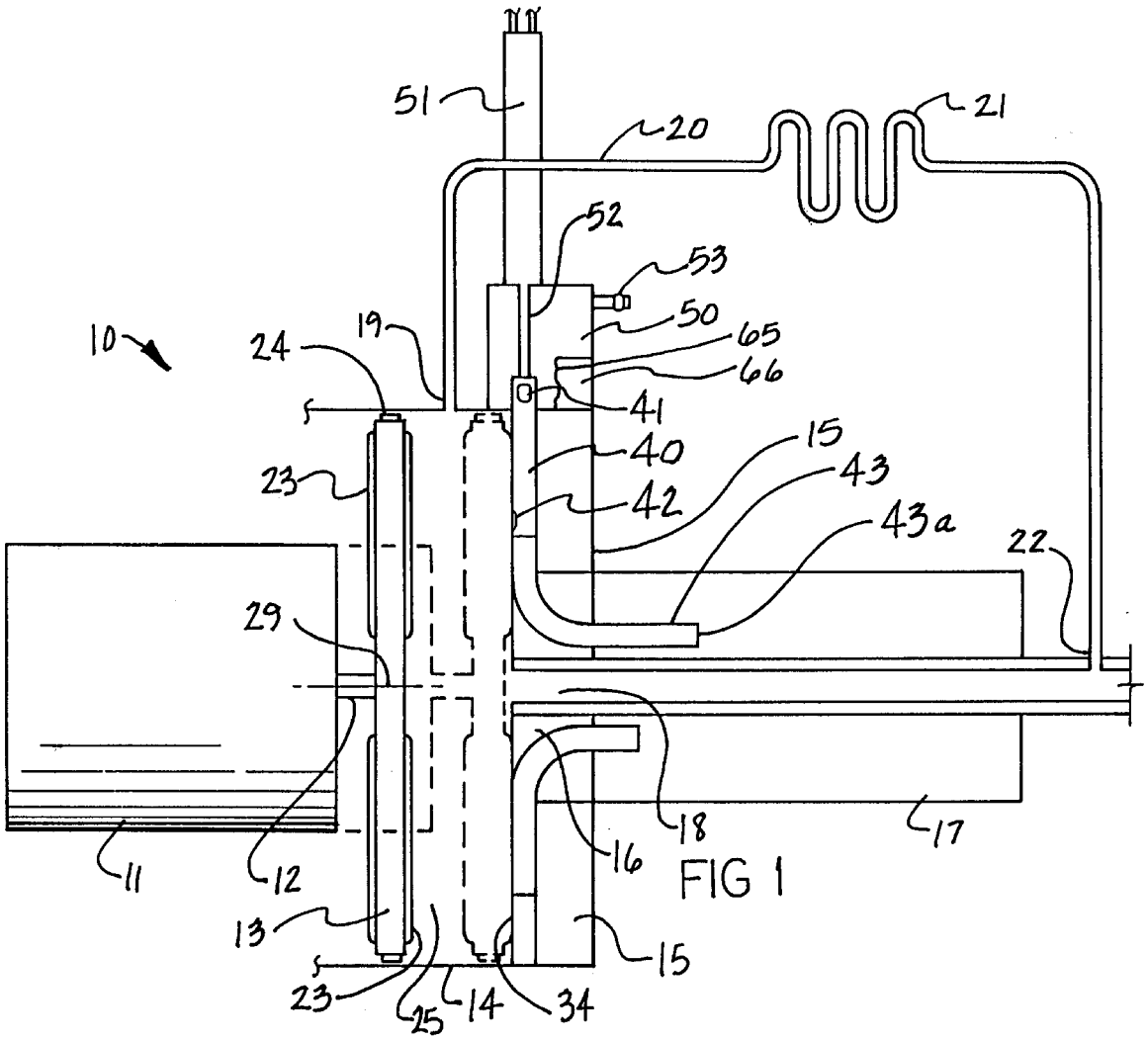
FIG. 1 is a cross sectional view of the pump apparatus, comprising a pump motor, impeller, and front plate having one transtator, a transtator receiver and an actuating cylinder.
Figure 8:
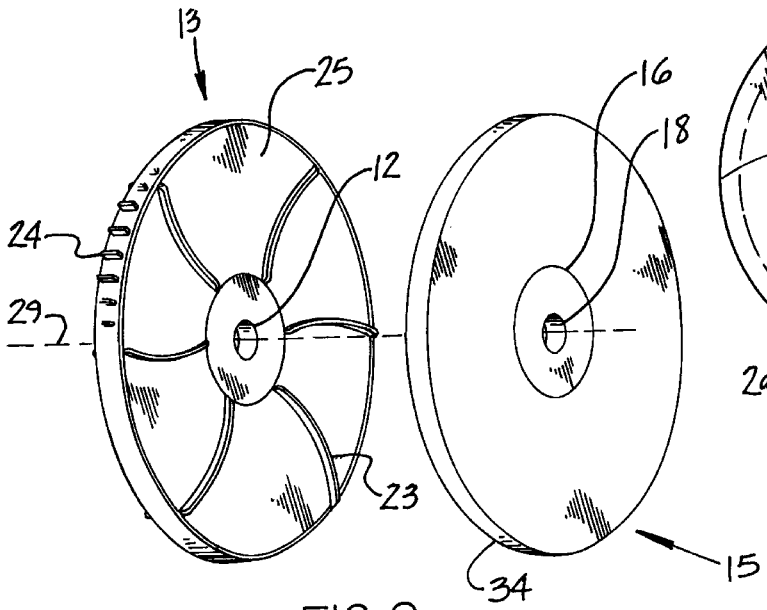
FIG. 8 is an exploded perspective view of a pump impeller, with six vanes, and front plate.

Referring to FIG. 1, a multi pressure fluid pumping apparatus 10 is shown. A pump housing 14 encloses a rotary impeller 13, which is fixed to a shaft 12. The shaft 12 is turned by a motor 11, which causes the impeller 13 to rotate within the pump housing 14. A plurality of vanes 23 protrude outward from one or both of the flat sides of the impeller 13. These vanes 23 may be straight, extending radially outward along the face of the impeller 13, or curved as depicted in FIG. 8. End vanes 24 may also, but not necessarily, protrude outward along the peripheral edge of the impeller 13.

Referring to FIG. 1 and also to FIG. 8, the impeller 13 is positioned within the pump housing 14 immediately adjacent to a front plate 15, with close tolerance between the front plate inner side 34 and vanes 23. While the shapes of the impeller 13 may vary, from a flat surface, to a somewhat conical shaped surface, the front plate inner side 34 must be shaped so as to receive the impeller 13 and vanes 23 in close proximity to the surface area of the front plate inner side 34.

The front plate 15 has a center plug 16 that defines a zero pressure intake port 18 and also functions as the front end cap for the filler receiver 17. Fluid passes through zero pressure intake port 18 and enters into a cavity 25 of pump housing 14. The cavity 25 is defined by the side of the impeller 13, front plate inner side 34, and center plug 16, with the cavity 25 extending radially outward from the impeller axis of rotation 29. A pump housing 14 may have one or more cavities 25, with each cavity 25 being defined by a rotary impeller 13 and a front plate inner side 34, in which the front plate 15 is positioned adjacent to the impeller 13. Each impeller 13 may have a front plate 15 positioned adjacent to each side of impeller 13, so that each impeller 13 may define one side of up to two cavities 25. The fluid in the cavity 25, moves outward radially, filling the portion of the cavity 25 that is subdivided along the vanes 23.

When the impeller 13 is rotating, the vanes 23 accelerate the fluid linearly, but forces the fluid to move in a circular path, following the arcual movement of the vanes 23 on the impeller 13. As the vanes 23 contact and move the fluid, centrifugal force applies pressure away from the axis of rotation 29, toward the periphery of the impeller 13. Fluid at the periphery of the impeller 13, will be subjected to the fastest rotational vane speed on the impeller 13, where pressure will be the maximum available for that particular pump 10 at a given impeller 13 rotational rate, and fluid flow rate. If end vanes 24 are present, they will also urge the fluid further outward from the axis of rotation 29.

There are several criteria that determine the amount of pressure that will be created in fluid, using a rotary impeller 13. The first criteria for determining the amount of pressure that will be created in fluid, using a rotary impeller 13, is the type of fluid being used. Heavier fluids, such as mercury, provide a great deal of pressure output for an operating pump system, due to the higher fluid density, compared with a lower density fluid, such as water, alcohol or oils.

The second criteria for determining the amount of pressure that will be created in fluid, using a rotary impeller 13, is the impeller's 13 rotational rate. Higher speeds of rotation allow vanes 23 and 24 to accelerate the fluid to higher velocities, thereby generating higher potential flow rates and pressures. The third criteria is the diameter of the impeller. Increased diameters allow greater pressure to be generated along an impeller 13 at a given rotational rate.

The fourth criteria is the flow rate of fluid through the pump 10. Higher fluid flow rates lower the maximum fluid pressure realized within the pump 10, as compared to a restricted fluid flow rate, which allows fluid to build up a higher maximum pressure along the periphery of the impeller 13.

An impeller 13 creates the highest amount of pressure along its peripheral edge, as compared to the fluid at other points closer to the axis of rotation 29. The closer the fluid is to the center axis of rotation 29, the less pressure it will realize, since the fluid closer to the axis of rotation 29 is moving at a slower linear speed than that farther away from the axis of rotation 29.

Figure 9:
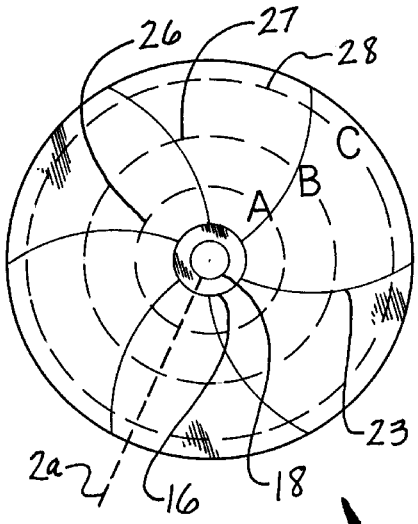
FIG. 9 is a two dimensional view of the flat side of the impeller.

Referring also to FIG. 9, a rotating impeller 13, having a plurality of vanes 23, acts on fluid, so that the fluid's pressure increases as one moves from the axis of rotation 29 toward the periphery of the impeller 13. For example, fluid entering at the zero pressure intake port 18 will have no significant pressure reading. If the impeller 13 is rotating, fluid at radiusA 26 will have a pressure dependent on the four criteria above, or p1. Fluid at radiusB 27, which is twice the distance from the zero pressure intake port 18 as fluid is at radiusA 26, will have approximately four times the equivalent pressure as the fluid located at radiusA 26, or p4. Likewise, fluid at radiusC 28 will have a pressure approximately four times higher than fluid located at radiusB 27, or p16. Fluid drawn off at various radial points, will exhibit a pressure force commensurate with the fluid at that particular radius.

Front Plate—Grooved (Tube Type)

Figure 6:
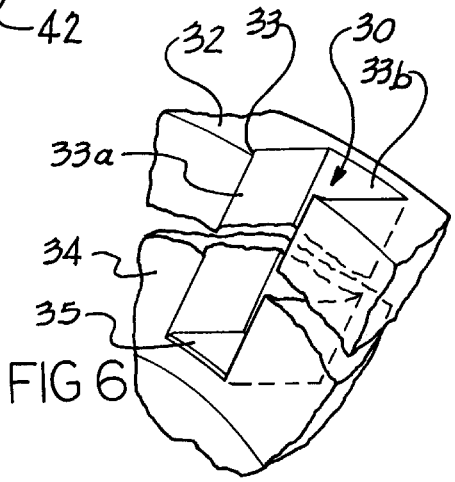
FIG. 6 is a fragmentary top and side perspective view of the front plate, edge and inner side, depicting the transtator groove.
Figure 5:
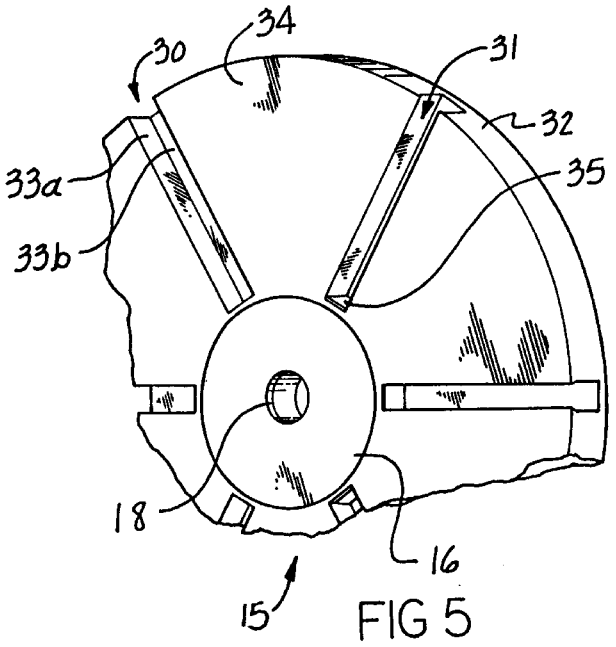
FIG. 5 is a fragmentary perspective view of a front plate depicting multiple grooves.

Referring also to FIG. 5 and FIG. 6, the front plate 15 has a front plate inner side 34 that is shaped so that it can be immediately adjacent to the impeller 13 and vanes 23. The front plate 15 has a groove 30, defined by groove side walls 33*a,* a groove back wall 33*b,* and an open side with a gap defined by beveled edge guides 33. The groove side walls 33*a* and back wall 33*b* define an open end on the front plate edge 32. The other end of the groove 30 defines a filler hole 35, with the gap defined by the beveled edge guides 33 closed to define the filler hole 35. The groove 30 preferably has a uniform depth and inner dimensions, with the beveled edge guides 33 defining a narrower opening than the interior dimensions of the groove 30.

Referring to FIG. 5, the front plate 15 may have a second groove 31, with dimensions similar to groove 30. A plurality of grooves, similar to groove 30 and 31 may be placed on the front plate 15, so that they extend lengthwise radially from the zero pressure intake port 18 or axis of rotation 29 to the peripheral front plate edge 32, with a separate transtator in each of the grooves. Groove placement and number on the front plate 15, are limited in number only by their size and available area of the front plate inner side 34. The front plate 15, having a groove 30, or additional grooves, may replace front plates on existing traditional rotary impeller pumps (not shown).

Transtator—Tube Type

Figure 2:
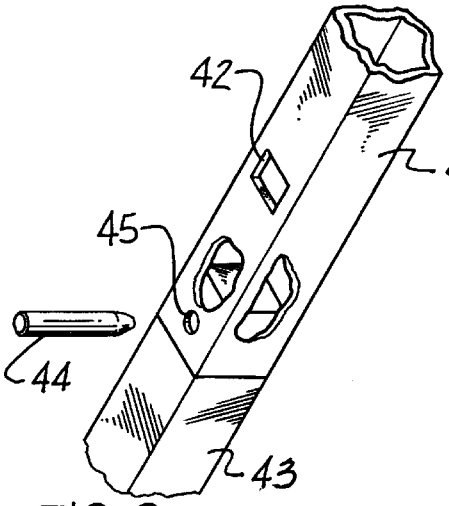
FIG. 2 is a fragmentary perspective view of the bottom portion of the tube type transtator and top portion of the flexible filler, with a portion of the transtator cut away to depict the filler inside the transtator, as they are fixed to each other.
Figure 3:
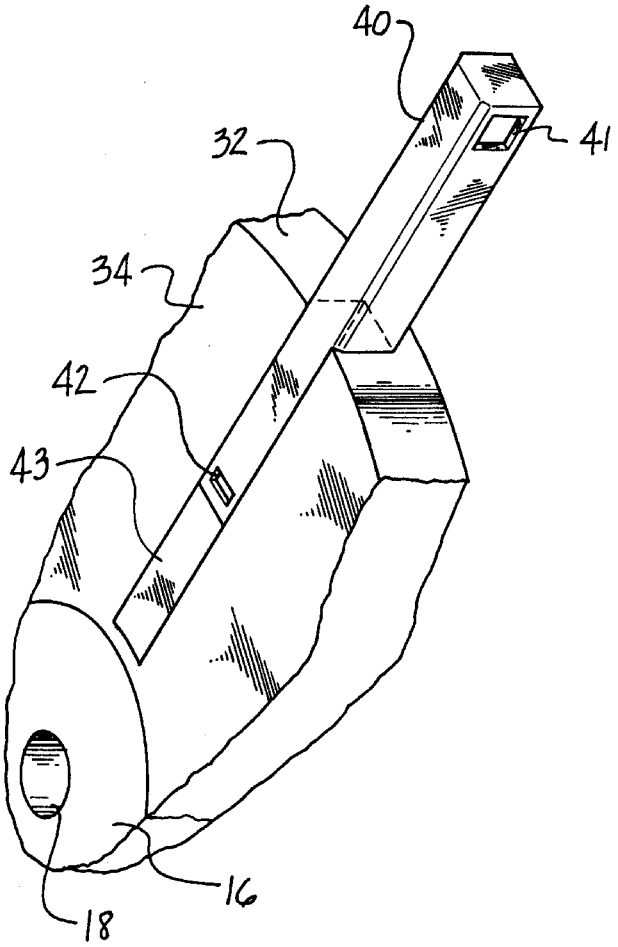
FIG. 3 is a perspective view of a tube type transtator and filler, fitted within a transtator groove on a fragmentary view of the front plate.

Referring to FIGS. 1 through 4 and 7, a transtator 40 is shown, comprising a tube type object that has dimensions that closely fit those of the groove 30. Although a squarish cross sectional shape is shown in FIG. 3, with the inner walls of the groove 30 defining a shape and space that is just slightly larger than the transtator 40, many other shapes may be used, as long as the transtator 40 fits within, and is held within, the confines of the groove 30.

The tube type transtator 40 is positioned adjacent to the rotary impeller 13, with the tube type transtator's 40 path of travel defined by a groove 30 in the front plate 15.

The transtator 40 has an open intake port 42 and exit port 41, which are connected to each other through an open passageway that runs through the interior length of the tubular transtator 40 so that the transtator 40 defines a passage way from the open port through the transtator to the exit port 41. Referring to FIG. 2, filler 43 is attached to the transtator's 40 bottom end, near intake port 42. Filler 43 may be attached in a variety of methods, such as through the use of a pin 44, which is pushed through a pin hole 45 on the transtator 40, with the pin 44 placed through the end of the filler 43 that is pushed up into a recessed area at the end of the transtator 40. Filler 43 preferably comprises a flexible material, with cross sectional dimensions similar to those of the cross sectional dimensions of the transtator 40.

Figure 7:
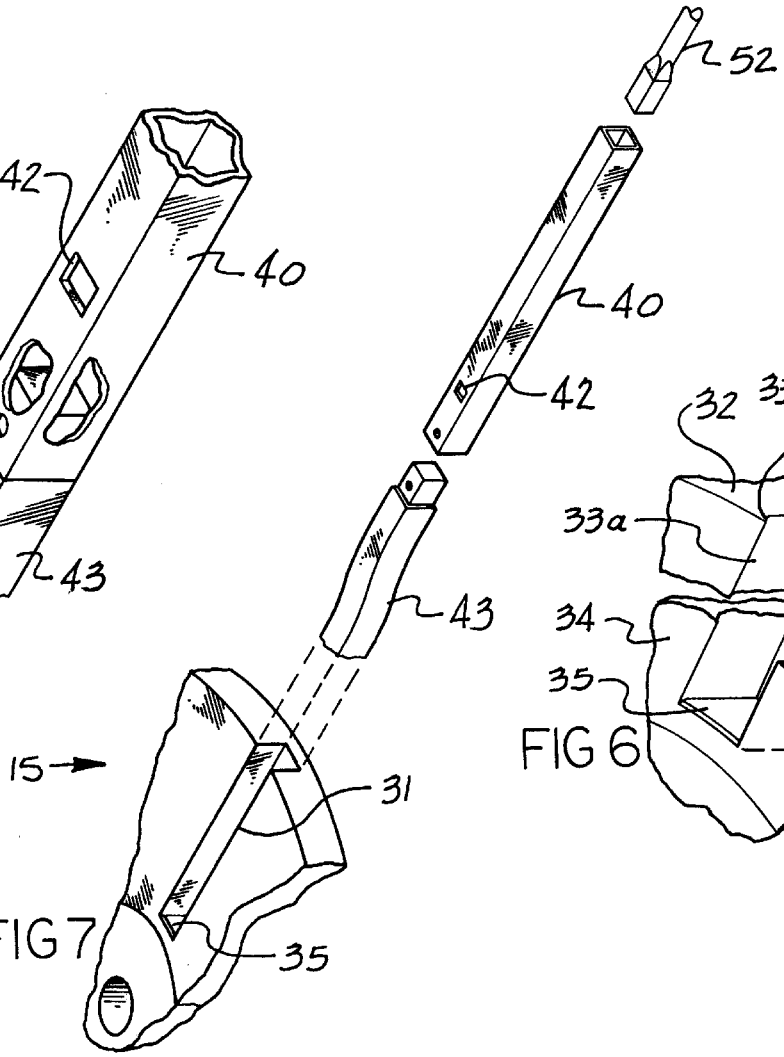
FIG. 7 is an exploded perspective view of a fragmentary portion of the front plate and tube type transtator and transtator filler.

Referring also to FIG. 7 and FIG. 1, the transtator 40 and attached filler 43 are positioned in the groove 30, by directing the filler end 43*a* through the opening on the front plate edge 32, and then sliding the remaining portion of the filler 43 and transtator 40 into the groove 30, until the filler end 43*a* moves through the filler hole 35, into a filler receiver 17, as shown in FIG. 1. Referring also to FIG. 3, the transtator 40 is positioned properly in the groove 30, when a portion of the filler 43 is in the filler receiver 17, and the intake port 42 is positioned facing outward, or away from the front plate inner side 34, facing the cavity 25 and visible through the gap of the groove 30. The port 42 should have sidewalls which are angled, in relation the front plate inner side, with the direction of the angle in the direction of the movement of the impeller 13 is adjacent to the port 42. The path of travel for the transtator 40 is defined by the groove 30.

Figure 4:
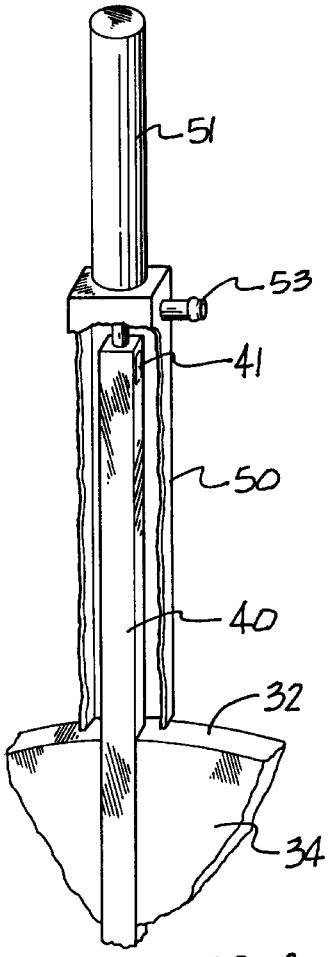
FIG. 4 is a fragmentary side view of an actuating hydraulic cylinder, transtator receiver and front plate.

Referring also to FIGS. 1 and 4, the portion of the transtator 40, having the exit port 41 moves and, is enclosed within a transtator receiver 50. The transtator receiver 50 comprises a hollow cavity and a variable pressure outlet 53, which allows fluid to exit the transtator receiver 50, for an intended use. Generally, a pressure line (not shown) may be attached to the variable pressure outlet 53.

Impeller 13 is positioned adjacent to the front plate 15, with the transtator 40 properly positioned within the groove 30, so that the intake port 42 is positioned along the length of the groove. Fluid which has acquired pressure from the rotating impeller 13, enters intake port 42, which is positioned radially from the axis of rotation 29 and moves through the tubular transtator 40, and through exit port 41 into the transtator receiver 50.

Referring again to FIG. 1, flutter, or fluctuations in pressure caused by the passing of the vanes 23 over the intake port 42, are diminished, using the transtator receiver 50, which has a flexible diaphragm, comprising a membrane 65 that separates the fluid filled portion from an area of compressible gas 66, which allows for small variations in volume in the fluid filled portion of the transtator receiver 50. This has the effect of dampening the pressure fluctuations, prior to the pressurized fluid exiting through the variable pressure outlet 53, in which the membrane 65 will deform slightly toward the compressible gas 66, when sudden pressure surges enter the transtator receiver 50.

These diaphragms are preferable, but not necessary to the operation of this invention, as shown in FIG. 4, which shows a transtator receiver 50 without a diaphragm membrane. 65.

Positioning intake port 42 along the length of the groove 30, allows the intake port 42 to be positioned radially to the axis of rotation 29, so that it can receive fluid at different or desired levels of pressure. Filler 43 prevents fluid under pressure from returning to an area of lower pressure, which is generally closer to the axis of rotation 29. If the filler 43 is not occupying or using that portion of the groove 30, that the transtator 40 does not occupy, then fluid would tend to flow through the unoccupied portion of the groove 30, back toward the zero pressure intake port 18 and axis of rotation 29, and cycle back into the impeller 13 causing drag and inefficiency in the pump's 10 ability to produce higher fluid pressures.

Referring also to FIGS. 1 and 4, transtator 40 is actuated within the groove 30 by any linear force, but is preferably applied by a hydraulic or pneumatic cylinder 51, having a cylinder rod 52 that is slidably disposed within the cylinder 51, and fixed to the transtator 40. As the cylinder rod 52 moves in and out of the cylinder 51, the transtator 40 is positioned radially within the groove 30, in relation to the axis of rotation 29. The cylinder 51 is actuated by an external means.

Transtator—Rod Type and Fluid Channel

Referring to, and incorporating the previous description of a Rotary Impeller Pump. An additional method of utilizing the idea of a moveable entry port 42, that is positioned radially along the side of a rotating impeller 13, uses a rod transtator 38, which is either solid, or at least having a cross sectional rigid shape that is impermeable to the liquid contacted within the pump 10, in which a single port 39 exposes a separate inner chamber, or fluid channel 46 that allows fluid to move from the area of the movable port 39 to the exit port 47.

Figure 10:
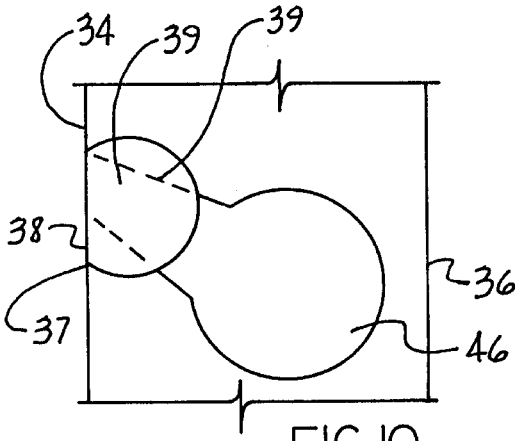
FIG. 10 is a cross sectional view of a front plate fluid channel, and rod type transtator and port.
Figures 11, 12:
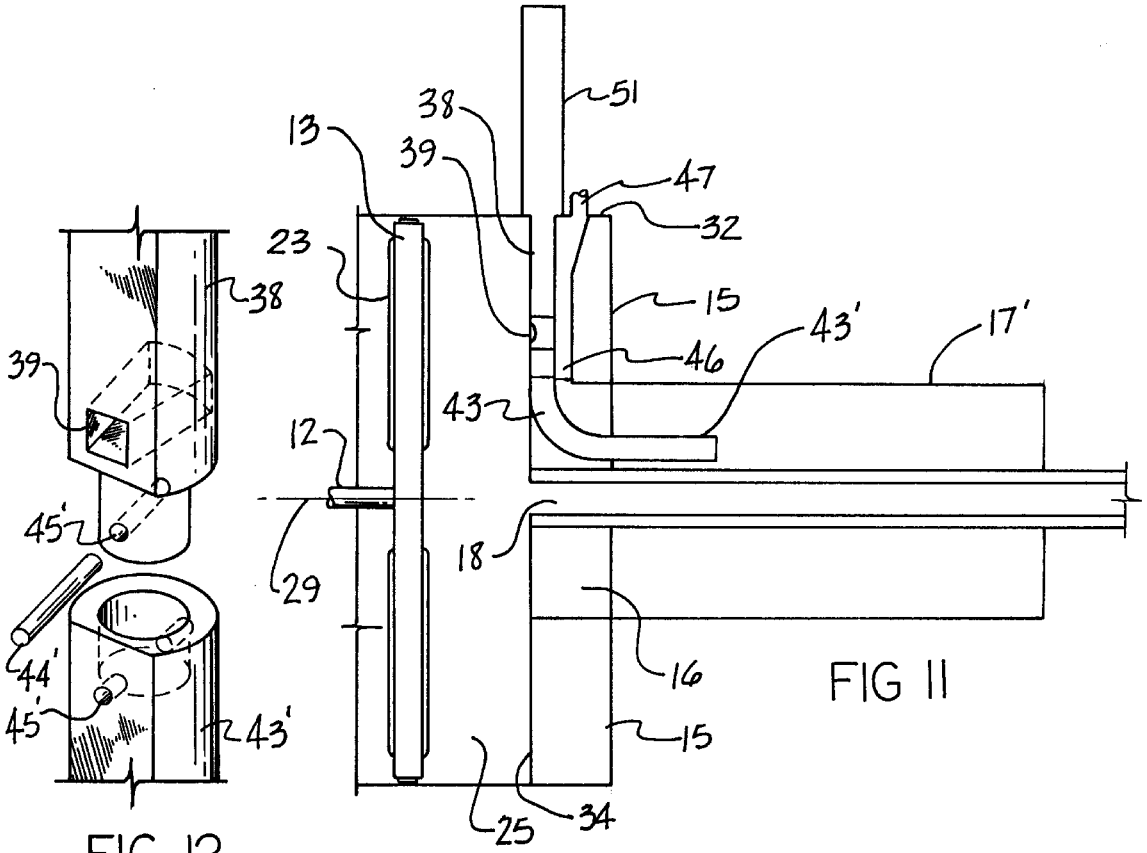
FIG. 11 is a cross sectional view of a pump apparatus, depicting a front plate with a fluid channel, and a cylinder rod type transtator, where the cylinder rod and transtator are one in the same.
FIG. 12 is a perspective view of a rod type transtator having a port for use with a front plate having a separate fluid channel, and the top portion of the transtator filler and connecting pin.

Referring also to FIGS. 10, 11 and 12, A centrifugal pump housing, having at least one cavity 25 is shown, in which cavity 25 is defined by a rotary impeller 13 and at least one front plate 15, where the front plate 15 is positioned adjacent to the impeller 13. The front plate 15 defines at least one cylinder rod transtator groove (transtator groove) 37, with the length of one side of the groove defining a gap, open to the front plate inner side 34, and the other side length having a gap that exposes a fluid channel 46. The bore of the transtator groove 37 preferably extends to the center plug 16, terminating at a transtator filler hole 35, with the length of the transtator groove 37 extending radially from the impeller's axis of rotation 29.

A cylinder rod transtator (rod transtator) 38 is positioned within each transtator groove 37, with the rod transtator 38 shaped to fit the bore of the transtator groove 37. Although a cylindrical cross sectional shape is shown in FIG. 10, with the inner walls of the transtator groove 37 defining a shape and space that is just slightly larger than the transtator 38, many other shapes may be used, as long as the transtator 38 fits within, and is held within, the confines of the groove 37. A transtator filler (filler) 43' may be attached to the bottom end of the rod transtator 38, preferably by urging a pin 44' through common pin holes 45'. The second end of the filler 43' is positioned through a filler hole 35', with the filler end 43' in the filler receiver 17'.

Referring again to FIG. 12, the rod transtator 38 defines a rod transtator port (rod port) 39, which has a bore that extends through the rod transtator 38 and functions as a movable passageway, allowing the fluid from one side, that is adjacent to the impeller 13 in cavity 25, to move through rod port 39, and into the fluid channel 46. Fluid channel 46 is enclosed within the front plate 15 in which the length of the fluid channel 46 is adjacent to the length of the transtator groove 37. A fluid channel exit port 47, to which a pressure line (not shown) may be attached, is preferably positioned at the peripheral side of front plate 15.

Referring again to FIG. 11, the fluid channel 46 is immediately adjacent to the transtator groove 37, with the transtator groove 37 and fluid passageway 46 sharing a common gap that extends the length of each.

The rod transtator 38 is positioned within the transtator groove 37, and movable within the transtator groove 37, so that the rod port 39 can be moved radially in relation to the impeller's axis of rotation 29. Actuation of the rod transtator 38 may be done by any linear force. A hydraulic cylinder 51 may be position so that the cylinder rod 52, which is slidably disposed within the cylinder 51, and consists of or can be fixed to the rod transtator 38, so that movement of the rod transtator 38 occurs when the hydraulic cylinder rod moves.

Figure 14:
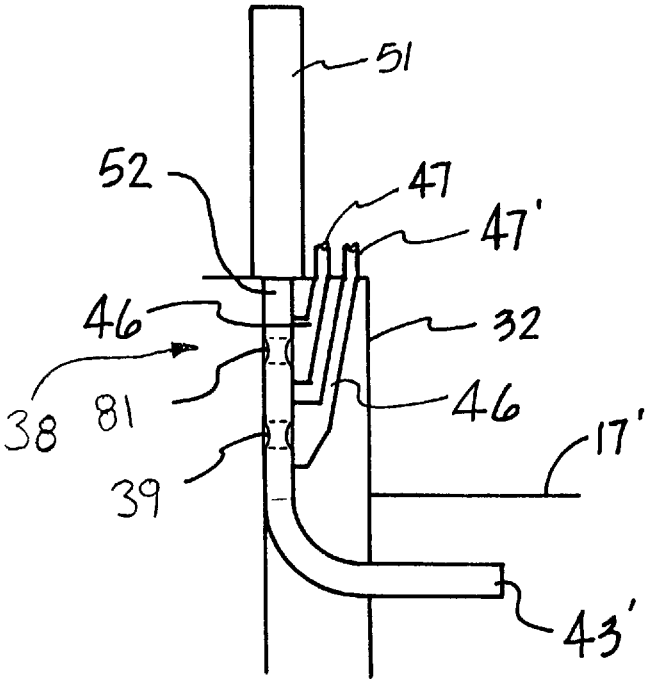
FIG. 14 is a partial cutaway view of the front plate and rod type transtator with two rod ports, showing two fluid channels.

Referring also to FIG. 11 and 14, the rod transtator 38 may have a second rod port 81, and with regard to the front plate 15 and adjacent impeller 13, has dimensions and orientation similar to rod port 39. This second rod port 81 is located at a different point along the length of the rod transtator 38, having a bore which also extends through the rod transtator 38.

Rod port 39 and the second rod port 81 will each contact fluid of different pressures and flow rate, with regard to their position in radial relation to the impeller 13. Since the second rod port 81 is positioned farther from the center of the front plate 15, and closer to the periphery of the front plate 15, than is rod port 39, the second rod port 81 will always contact fluid pressure and potential flow rates greater than those contacted by rod port 39. The fractional relationship of pressures that each rod port 39 and 81 contact, is defined by the distance of rod ports 39 and 81 from each other, and the proportionate difference between rod port 39 and the impeller's axis of rotation 29. If the distance between rod port 39 and the axis of rotation 29 is equivalent to the distance between rod port 39 and the second rod port 81, then the difference of pressures and potential flow rates between rod ports 39 and 81 should be at an approximate 4 to 1 ratio. If the rod transtator 52 is moved, radially in relation to the axis of rotation 29, so that the distance between rod port 39 and the axis of rotation 29 is greater than the distance between rod ports 39 and 81, then the pressure and potential flow rate between rod ports 39 and 81 is reduced below an approximate 4 to 1 ratio. Similarly, if the distance between rod port 39 and the axis of rotation 29 is less than the distance between rod ports 39 and 81, the pressure and potential flow rate between rod ports 39 and 81 will exceed a 4 to 1 ratio.

In order to deny fluid at a higher pressure and flow rate that enters into the second rod port 81, from flowing to rod port 39, when a rod transtator 38 has a rod port 39 and a second rod port 81, each port 39 and 81 will allow fluid to move from the cavity 25 into a specific fluid channel 46 or 46'. Rod port 39 will only allow fluid to move from the cavity 25 into fluid channel 46, while the second rod port 81 will only allow fluid to move from the cavity 25 into fluid channel 46'. Each fluid channel 46 and 46' has its own exit port 47 or 47'. Fluid channel 46 defines a passageway that is enclosed within the front plate 15 and has a length that extends from the area that rod port 39 moves within, to exit port 47 at the periphery of the front plate 15.

Fluid channel 46' defines a passageway that is enclosed within the front plate 15 and has a length that extends from the area that the second rod port 81 moves within to exit port 47' at the periphery of the front plate 15.

In order to deny fluid flow between channels 46 and 46', fluid channel 46 has a defined route to the periphery of the front plate 15 that is adjacent to fluid channel 46', but separated from it by a divider or wall.

Referring again to FIG. 10, the rod port 39 has side walls 39' that are preferably angled, rather than perpendicular, in relation to the face of the impeller 13, and the surface of the front plate inner side 34, to allow pressurized fluid, accelerated by vanes 23, to move through rod port 39 more efficiently, due to the angular momentum imparted to the fluid by the impeller 13 and vanes 23. The angle of the walls of the rod port 39 are preferably angled in the same direction, from a line perpendicular to that of the side of the impeller 13, as the adjacent rotational movement of the impeller 13, The rod port 39 opening facing the fluid channel 46 should define an aperture of larger size than that portion of the transtator port 39 that opens toward the impeller 13. This size differential allows smoother and more efficient flow of fluid, by decelerating the fluid before it turns into the fluid passageway 46, toward the front plate edge 32.

A diaphragm, as shown in FIG. 1, and described for use with the tube type transtator 40, may also be used with the rod type transtator 38, in which a membrane 65 separates fluid from an area of compressible gas 66, and may be located within or external to the fluid channel 46. Such a diaphragm may also be set at any point along the flow of fluid after it has exited the cavity 25.

Transtator—Through Tube Type

Figure 13:
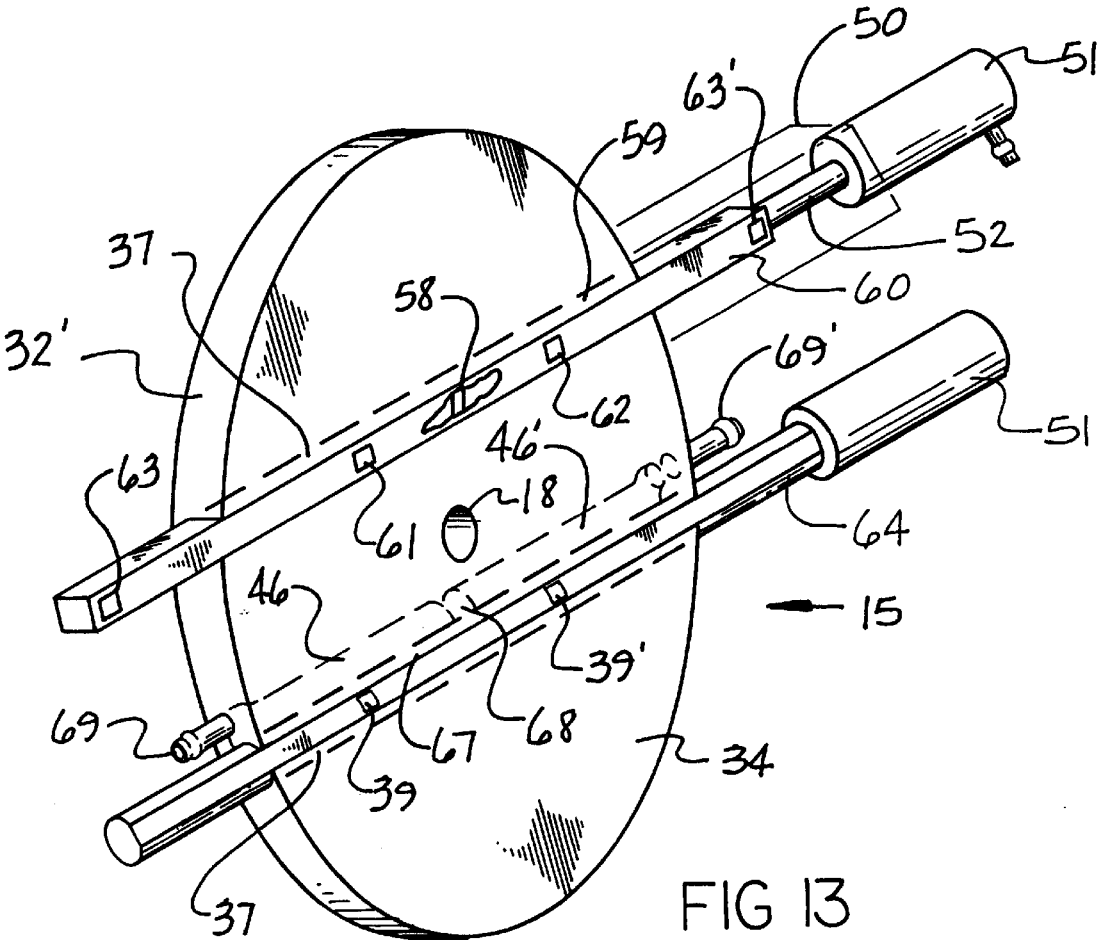
FIG. 13 is a perspective view of the front plate having both through tube type and through rod type transtators with dual entry/exit ports.

While filler 43 and rod filler 43' allow optimal pressure and flow rates within the pump housing 14, a transtator that fully occupies the full length of its resident groove may also be used. This type of transtator can be described as two types, both of which are depicted in FIG. 13. The same basic rotary impeller pump structure is used, as recited above, with the differences comprising the length and positions of the various transtator and grooves.

The centrifugal pump housing 14 has at least one cavity 25, defined by a rotary impeller 13 and at least one front plate 15, where the front plate 15 is positioned adjacent to the rotary impeller 13.

One or more transtator grooves 59 are defined by the front plate 15, with said grooves 59 extending radially from the axis of rotation 29, or with said grooves 59 bisecting the front plate 15, without crossing the center of the front plate, that shares the impeller's axis of rotation 29.

Referring to FIG. 13, a through tube type piece transtator 60 is positioned within transtator groove (groove) 59, with the length of the transtator 60 being greater than the length of the groove 59. The groove 59 extends from one peripheral edge to another peripheral edge of the inner side of the front plate 34, with the open side of the groove 59 facing the rotary impeller 13. The transtator 60 defines at least one entry port 61, with a configuration as described above for a tube type transtator, which opens into a fluid passageway located within the transtator 60 that connects the entry port 61 to the exit port 63. A second entry port 62 may be used, with a separate passageway within the transtator 60 that connects to exit port 63'. If a second entry port 62 is present, a divider wall 58 should partition the passageway within the transtator 60, so that each entry port 61 and 62, have their own respective passageways to their respective exit ports 63 and 63'. Exit ports 63 and 63' may allow fluid to enter into a transtator receiver 50, as described above and depicted in FIG. 1 or FIG. 4. No filler 43 is necessary, since the transtator 60 occupies the entire groove 59. A transtator 60, positioned in the transtator groove 59, where the transtator 60 has a length greater than the transtator groove 59, and defines a port 51 that is open toward the cavity 25, which allows access to a fluid passageway and an exit port 63, and where the transtator 60 can be moved within the transtator groove 59, so that the port 61 can be positioned in radial relationship to the impeller's axis of rotation 29.

A front plate 15 may define a plurality of grooves 59, with a separate transtator 60 in each of the grooves 59. In the event a transtator 60 has a single port 61, fluid will enter the port 61, move through the fluid passageway with in transtator 60, to an exit port 63. If the transtator 60 has two ports 61 and 62, port 61 will allow fluid to enter and move through the fluid passageway within the transtator 60 to exit port 63, while fluid entering through a second port 62 will move through a separate fluid passageway with in the transtator 60 to a second exit port 63'.

Transtator—Through Rod Type

This type of transtator is used with a fluid pumping apparatus 10, as described above in the discussion of 'Transtator—Rod Type and Fluid Channel," with the front plate 15 used in this structure having a transtator groove 37 that extends from one point along the peripheral side of the front plate to another point along the peripheral side of the front plate 15. The transtator groove 37 may bisect the center point of the front plate 15, which is at the point along the impeller's axis of rotation 29, or at any other position on the front plate 15, with the transtator groove 37 defining a gap that runs the length of the transtator groove 37. As shown in FIG. 13, a through type rod transtator (transtator) 64, is positioned so that it moves within a transtator groove (groove) 37. The shape of the transtator groove 37 and rod transtator 64 may be cylindrical, as shown in the cross sectional view in FIG. 10, but other shapes are allowable, as long as the rod transtator 64 is rigidly held within the transtator groove 37, so that it can move only along the length of the transtator groove 37.

The transtator 64 has a length that exceeds the length of the groove 37, and defines a transtator port 39, which allows fluid access to fluid channel 46. The transtator port 39 is the same type of port as described in the specification of the "Transtator-Rod Type and Fluid Channel." The transtator 64 may also have a second transtator port 39', with similar dimensions as port 39. The second port 39' is also located along the length of the transtator 64, and allows fluid between the impeller 13 and front plate inner side 34, to move through the transtator port 39' into a second fluid channel 46' to a second exit port 9'. Fluid channel 46 and fluid channel 46' are separated by a channel divider 68, which partitions the fluid channels 46 and 46' so that one port 39 or 39' will only allow fluid access to a single fluid channel 46 or 46'. Fluid that moves through transtator port 39' into fluid channel 46' will exit only through exit port 69'.

The direction of fluid presupposes that the pressure of the fluid entering transtator ports 39 and 39' is greater than the fluid pressure within fluid channel 46. If the pressure within fluid channel 46 is greater than the pressure in the entry port 39 or 39', then the flow of fluid will be reversed, so that fluid will enter through the exit port 69 or 69', travel through the fluid channel 46 or 46' and through transtator port 39 or 39', back into fluid cavity 25.

It is not necessary that any of the grooves described, or any other added grooves run in a direct radial line along the front plate 15, from the axis of rotation 29, as long as they allow a tube type transtator 40, rod type transtator 38, through tube type transtator 60 or through rod type transtator 64 to slide within it, so that any transtator port may be moved so as to vary the distance between it and the axis of rotation 29.

No filler 43, center plug 16 or filler receiver 17 is necessary with a through type tube or rod transtator 60 or 64, since they occupy the entire groove 59 or 37.

Multiple Impellers and Front Plates

An increase in the possible number of transtators 38, 40, 60 and 64, of a given size and capacity that can be powered by a single impeller 13 may be achieved, if front plates 15, are positioned on both sides of an impeller 13, with vanes 23 also on both sides of the impeller 13, with the obvious necessary inclusion of an enlarged zero pressure intake port 18 with the impeller drive shaft 12 passing through it. A plurality of impellers 13, rotating on a single shaft 12, with each side of the impellers 13 having vanes 23 and an adjacent facing front plate 15, allows many additional transtators and different types of transtators to be used in a single pump system (not shown).

Referring again to FIG. 1, excess pressure and heat, generated during the pumping process, can be controlled using a high pressure outlet 19, which allows fluid under the highest pressure, and subjected to the highest level of heat, to move through a high pressure bleed line 20, through cooling coils 21, and allowed to return through a return port 22 to the fluid in the zero pressure intake port 18 area.

There are numerous variations of materials, designs, and shapes that may be utilized for the components, that may be used to accomplish this type of functioning apparatus.

From the foregoing statements, summary and description in accordance with the present invention, it is understood that the same are not limited thereto, but are susceptible to variations, changes, and modifications as known to those skilled in the art and we therefore do not wish to be limited to the details shown and described herein, but intend to cover all such variations, changes and modifications which would be encompassed by the scope of the appended claims.

I claim:

1. A transtator apparatus, as a source of variable fluid pressure and delivery rate comprising:

(A) a centrifugal pump housing having at least one cavity with each cavity defined by a rotary impeller and a front plate that is positioned adjacent to the rotary impeller;

(B) at least one transtator, positioned adjacent to the rotary impeller, with the transtator's path of travel defined by a groove in the front plate, where the transtator defines an open port, with the port facing the cavity, and movable radially in relation to the axis of rotation to the rotary impeller.

2. A transtator apparatus, as a source of variable fluid pressure and delivery rate, as recited in claim 1, in which the transtator fits within a groove on a front plate, that extends lengthwise radially from the impeller's axis of rotation to the front plate edge.

3. A transtator apparatus, as a source of variable fluid pressure and delivery rate, as recited in claim 1, in which the transtator exit port opens from the transtator passageway into the transtator receiver, comprising a hollow cavity and a variable pressure outlet.

4. A transtator apparatus, as a source of variable fluid pressure and delivery rate, as recited in claim 1, in which the front plate defines a plurality of transtator grooves, with a separate transtator in each of the grooves.

5. A transtator apparatus, as a source of variable fluid pressure and delivery rate, as recited in claim 1, in which a filler is attached to the transtator's bottom end, with the filler comprising a flexible material, having cross sectional dimensions similar to those of the cross sectional dimensions of the transtator, and where a portion of the filler is in a filler receiver, and a portion of the filler is in the groove.

6. A transtator apparatus, as a source of variable fluid pressure and delivery rate, as recited in claim 1, in which the transtator is actuated by a hydraulic cylinder, in which a cylinder rod is slidably disposed within the cylinder.

7. A transtator apparatus, as a source of variable fluid pressure and delivery rate, as recited in claim 1, where the transtator has a port with angled sidewalls, with the sidewalls angled in relation to the front plate inner side.

8. A transtator apparatus, as a source of variable fluid pressure and delivery rate comprising:

(A) a centrifugal pump housing having at least one cavity where each cavity is defined by a rotary impeller and a front plate that is positioned adjacent to the rotary impeller;

(B) a least one fluid channel enclosed within the front plate;

(C) at least one groove able to receive a rod transtator, within the front plate, with the length of one side of the groove defining at least one gap that exposes a fluid channel, and the other side of the groove defining a gap open to the front plate inner side;

(D) a rod transtator, positioned adjacent to the impeller and within the transtator groove, with at least one rod port, with the rod transtator movable lengthwise within the groove, so that the port is movable radially in relation to the impeller's axis of rotation.

9. A transtator apparatus, as a source of variable fluid pressure and delivery rate, as recited in claim 8, in which the length of the transtator groove on the front plate extends radially from the impeller's axis of rotation.

10. A transtator apparatus, as a source of variable fluid pressure and delivery rate, as recited in claim 8, where a membrane separates the fluid from an area containing compressible gas, which is located within or connected to the fluid channel.

11. A transtator apparatus, as a source of variable fluid pressure and delivery rate, as recited in claim 8, in which the front plate defines a plurality of transtator grooves and adjacent fluid channels, with a separate rod transtator in each of the grooves.

12. A translator apparatus, as a source of variable fluid pressure and delivery rate, as recited in claim 8, in which a filler is attached to the rod transtator's bottom end.

13. A transtator apparatus, as a source of variable fluid pressure and delivery rate, as recited in claim 8, in which the transtator is actuated by a hydraulic cylinder, in which a cylinder rod is slidably disposed within the cylinder.

14. A transtator apparatus, as a source of variable fluid pressure and delivery rate, as recited in claim 8, where the transtator has a port with angled sidewalls, with the sidewalls angled in relation to the front plate inner side.

15. A transtator apparatus, as a source of variable fluid pressure and delivery rate, as recited in claim 8, where the rod transtator has two rod ports that are located at a separate points along the length of the rod transtator, where each rod port allows fluid access to one of two specific and separate fluid channels, with each channel having its own exit port.

16. A transtator apparatus, as a source of variable fluid pressure and delivery rate, comprising:

(A) a centrifugal pump housing having at least one cavity, where each cavity is defined by a rotary impeller and a front plate that is positioned adjacent to the rotary impeller;

(B) at least one groove, which extends from one edge to another edge of the inner side of the front plate, and which faces at least one rotary impeller;

(C) a through type transtator, positioned in the groove, where the transtator has a length greater than the groove, and defines a port that is open toward the cavity, which allows fluid access to a fluid passageway or channel and an exit port, and where the transtator is moved within the groove, so that the port is positioned in radial relationship to the impeller's axis of rotation.

17. A transtator apparatus, as a source of variable fluid pressure and delivery rate, as recited in claim 16, in which the front plate has a plurality of grooves, with a transtator in each of the grooves.

18. A transtator apparatus, as a source of variable fluid pressure and delivery rate, as recited in claim 16, in which the transtator is a tube type transtator, having a single port that allows fluid to enter and move through the transtator to an exit port.

19. A transtator apparatus, as a source of variable fluid pressure and delivery rate, as recited in claim 16, in which the transtator is a tube type transtator, having two transtator entry ports, in which the entry ports allow fluid to move through the transtator to their respective transtator exit ports.

20. A transtator apparatus, as a source of variable fluid pressure and delivery rate, as recited in claim 16, in which the transtator is a rod type transtator, having a single transtator entry port that allows fluid to enter and move through a fluid channel to an exit port.

21. A transtator apparatus, as a source of variable fluid pressure and delivery rate, as recited in claim 16, in which the transtator is a rod type transtator, having two transtator entry ports, with each transtator entry port allowing fluid to move into its respective section of a fluid channel that leads to each respective exit port.

* * * * *